US005608379A

United States Patent [19]

Narlow et al.

[11] Patent Number: 5,608,379

[45] Date of Patent: Mar. 4, 1997

[54] DEACTIVATABLE EAS TAG

[75] Inventors: Douglas Narlow, Coral Springs; Hubert A. Patterson, Boca Raton, both of Fla.

[73] Assignee: Sensormatic Electronics Corporation, Deerfield Beach, Fla.

[21] Appl. No.: 247,100

[22] Filed: May 20, 1994

[51] Int. Cl.[6] ..... G08B 13/24

[52] U.S. Cl. ..... 340/572; 335/153; 340/551

[58] Field of Search ..... 340/572, 551; 335/151, 152, 153

[56] References Cited

U.S. PATENT DOCUMENTS

| | | | |
|---|---|---|---|
| 4,063,229 | 12/1977 | Welsh et al. . | |
| 4,243,963 | 1/1981 | Jameel | 335/151 |
| 4,377,797 | 3/1983 | Jin et al. | 335/153 |
| 4,420,732 | 12/1983 | Jin | 335/151 |
| 4,736,207 | 4/1988 | Siikarla et al. | 343/895 |
| 4,862,124 | 8/1989 | Rando | 335/151 |
| 4,943,791 | 7/1990 | Holce | 335/151 |
| 5,128,641 | 7/1992 | Posey | 335/151 |
| 5,233,322 | 8/1993 | Posey | 335/151 |
| 5,257,009 | 10/1993 | Narlow | 340/572 |
| 5,293,523 | 3/1994 | Posey | 335/151 |

*Primary Examiner*—John K. Peng
*Assistant Examiner*—Albert K. Wong
*Attorney, Agent, or Firm*—Robin, Blecker, Daley & Driscoll

[57] ABSTRACT

A deactivatable EAS tag in which a circuit comprising a non-linear element causes the generation of a detectable signal in response to an interrogating signal and in which a first magnetic element is arranged to be brought from a first position where the magnetic element does not short the non-linear element to a second position where the magnetic element shorts the non-linear element.

28 Claims, 7 Drawing Sheets

DEACTIVATABLE EAS TAG

BACKGROUND OF THE INVENTION

This invention relates to tag devices utilized in electronic article surveillance (EAS) systems and, more particularly, to EAS tag devices which can be deactivated and reactivated.

EAS systems are well known in the art and are widely used for inventory control and to prevent theft and similar unauthorized removal of articles from a controlled area. Typically, in such systems EAS tags are attached to the articles and a transmitter and an associated receiver are located at an exit to the controlled area. The transmitter serves to generate a field which interacts with any tags passing through the exit area or surveillance zone. The receiver serves to detect one or more predetermined detectable signals resulting from these interactions. Upon detection of a predetermined signal, the EAS system generates an alarm indicating the presence of a tag and its associated article in the surveillance zone.

One type of EAS tag which is in use today includes a nonlinear or mixing element, e.g., a semiconductor diode, and antenna elements. This tag is adapted to interact with the transmitted field by reradiating signals which can then be received by a system receiver, An EAS system incorporating an EAS tag of the above-type is disclosed in U.S. Pat. No. 4,736,207, entitled TAG DEVICE AND METHOD FOR ELECTRONIC ARTICLE SURVEILLANCE, which issued to Silkaria, et al. on Apr. 5, 1988 and is assigned to the same assignee hereof. In the system of the '207 patent, a first high frequency electromagnetic field and a second lower frequency electrostatic field having a modulation characteristic are transmitted by the system transmitter. The EAS tag of the system interacts with these fields to cause the generation of an electromagnetic field which includes frequency components at the sum and difference of the high frequency and modulated lower frequency. These components are then detected by the system receiver to recover the modulation characteristic which results in generating the system alarm.

The '207 patent also mentions that the EAS tag can be deactivated. This is accomplished by providing access to the conductive tag members for applying a destructive energy pulse to one or more of the mixing diode or other circuit elements.

U.S. Pat. No. 5,257,009, in the name of Narlow and also assigned to the same assignee hereof, discloses an EAS tag of the '207 patent type in which the tag is made reactivatable and deactivatable by using a switching capacitor placed in circuit with the tag components. By using a remotely generated field, the capacitor can be switched between first and second values to deactivate and reactivate the tag. The '009 patent mentions that the capacitor can be placed in series or in parallel with the mixing diode. In the latter position, the capacitor provides different shunting of the signal to the diode at its different values, thereby promoting the desired deactivation and reactivation.

U.S. Pat. No. 4,063,229, entitled ARTICLE SURVEILLANCE, issued to Welsh, et al. and also assigned to the same assignee hereof, describes an earlier form of the tag of the '207 patent. The '229 patent describes a technique for deactivating the tag in which the tag is subjected to a remotely generated RF field to burn out the diode. The '229 patent also discloses a further deactivation technique in which the diode circuit is opened by a remotely generated field to deactivate the tag.

In this case, a whisker of soft magnetic material bridges the first and second leads of the diode which are connected to form a loop. By applying a DC magnetic field having a transverse flux to the tag, the whisker end attached to the positive lead of the diode is lifted from the lead to break contact and open the diode circuit.

Opening of the diode circuit in this manner, however, causes the tag to reradiate spurious signals to the receiver. Frequently, many of these signals are sufficient to cause the EAS system to undesirably generate a false alarm. Consequently, the tag is not completely deactivated.

It is, therefore, an object of the present invention to provide a tag that can be deactivated in a way which prevents reradiation by the tag of spurious signals in an EAS system.

It is a further object of the present invention to provide a tag meeting the above objective and which is remotely deactivatable and reactivatable as well as inexpensive to fabricate.

SUMMARY OF THE INVENTION

In accordance with the principles of the present invention, the above and other objectives are realized in an EAS tag in which a circuit including a non-linear element is provided and in which a first magnetic element is also provided and is arranged to be brought from a first position where the magnetic element does not electrically short the non-linear element to a second position where the magnetic element electrically shorts the non-linear element. In this way, when the magnetic element is in the first position, the circuit is able to respond to an applied interrogating field of an EAS system, causing the generation of a detectable signal, and, when in the second position, the circuit is disabled or deactivated from responding to the applied interrogating field, to prevent generation of such detectable signal.

In the embodiments of the invention to be disclosed hereinafter, the EAS tag also includes a second magnetic element which is used to switch the first magnetic element between its first and second positions. In one embodiment, the first magnetic element comprises a flexible soft magnetic material and the second magnetic element a semi-hard magnetic material. In a second embodiment, the first magnetic element comprises a flexible semi-hard magnetic material and the second magnetic element a semi-hard magnetic material. In yet another embodiment, a holding means is provided to hold the first magnetic element in the second position and prohibit it from returning to the first position, so as to permanently deactivate the tag.

BRIEF DESCRIPTION OF THE FIGURES

The above and other features and aspects of the present invention will become more apparent upon reading the following detailed description in conjunction with the accompanying drawings in which.

DETAILED DESCRIPTION

Figure 1:
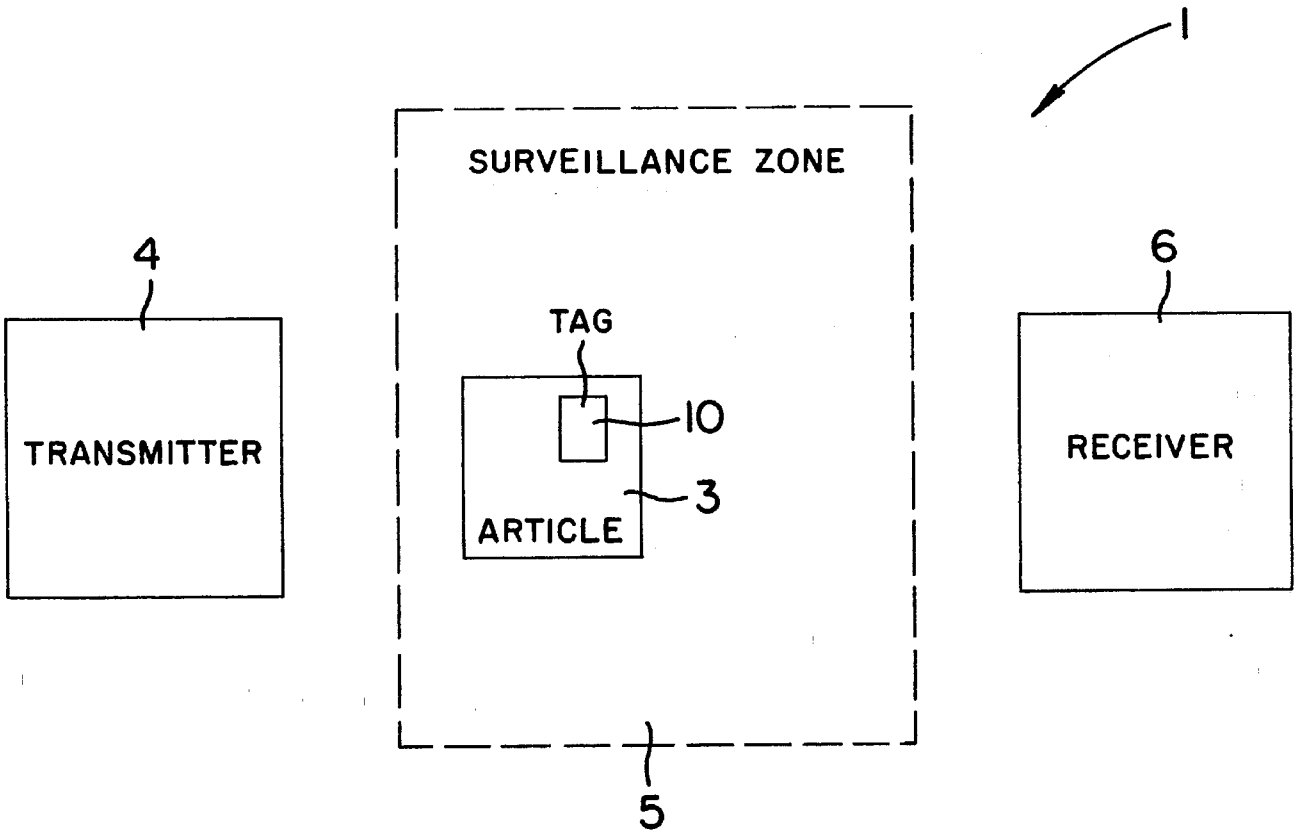
FIG. 1 illustrates an EAS system using a deactivatable EAS tag in accordance with the principles of the present invention.

FIG. 1 illustrates an EAS system 1 which utilizes a tag 10 for inventory control and to prevent theft or similar unauthorized removal of an article 3 from a controlled area such as a retail store. In the system 1, a transmitter 4 generates and transmits an electromagnetic interrogating field into a surveillance zone 5 at an exit of the controlled area. When the article 3, which includes the tag 10, passes within the surveillance zone 5, the tag 10 interacts with the transmitted interrogating field to generate a detectable signal at a receiver 6. The receiver 6, in turn, in response to this signal generates an alarm to indicate a possible theft or unauthorized removal of the article 3 from the controlled area.

Figure 2:
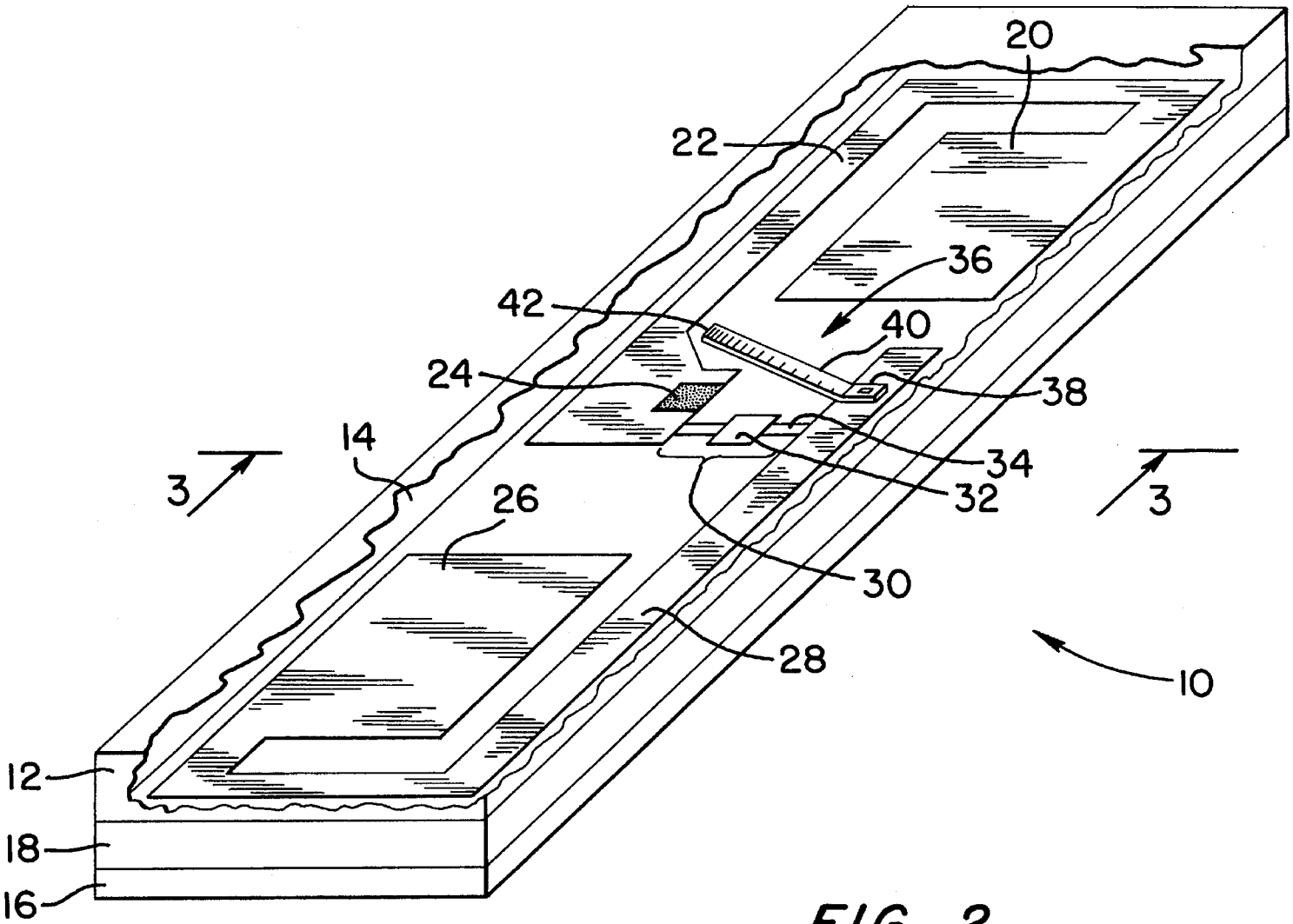
FIG. 2 illustrates a partial cutaway view of a first embodiment of a deactivatable EAS tag in accordance with the principles of the principles present invention.

FIG. 2 illustrates a remotely deactivatable and reactivatable tag 10 in accordance with the present invention and which can be used as the tag 10 in the system of FIG. 1. The tag 10 is similar in basic construction to the tag of the '207 patent, except for certain modifications which will become apparent from the discussion below and which make the tag more easily deactivatable and reactivatable. More particularly, the tag 10 includes a top cover 12 having an internal hollow 14 which is shown in a partial cutaway view in FIG. 2 for purposes of clarity. The tag 10 further includes a flat bottom layer 16 and a substrate 18 affixed between the top cover 12 and the bottom layer 16. The layer 16 may typically be an adhesive which is used to adhere the tag to an article.

The substrate 18 includes a first large conductive element 20 and a first conductive strip 22. The substrate 18 further includes a second large conductive element 26 and a second conductive strip 28. In the case shown in FIG. 2, the first conductive strip 22 is positioned adjacent and to the left of the second conductive strip 28 to form a gap 30. A diode 32 is positioned in the gap 30 and is electrically connected in series between the first strip 22 and the second strip 28 by the leads 34. As described above and in the '207 patent, with the tag 10 constructed in the above manner, the tag 10, when situated in the surveillance zone 5 of the EAS system of FIG. 1, will interact with the interrogating signals transmitted into the surveillance zone to cause the generation of a detectable signal.

In accordance with the principles of the present invention, the tag 10 is further adapted to permit remote and reliable deactivation and reactivation of the tag. To this end, the tag 10 is provided with a conductive, first magnetic element 36 having a base 38 from which extends an upwardly angled reed 40. The tag 10 is additionally provided with a second conductive, magnetic element in the form of a contact 24 which is electrically connected to the strip 22.

As shown, the base 38 of the magnetic element 36 is affixed to the second conductive strip 28 so that the reed 40 becomes upwardly angled across the gap 30. This causes the end 42 of the reed to be suspended at a predetermined height above the contact 24. This corresponds to a first position of the element 36.

In further accord with the invention, the element 36 is fabricated from a flexible and resilient soft magnetic material and the contact 24 from a semi-hard magnetic material. As a result, by magnetizing the contact 24, the reed element 40 can be subjected to a magnetic force to move the element downward and against the contact 24. This corresponds to a second position of the element 36.

As can be appreciated, in this second position, electrical contact is made between the reed 40 and the contact 24. This electrically connects the first and second conductive strips 22 and 28, thereby effectively short circuiting the diode 32. Furthermore, in this second position, the reed 40 is flexed and, therefore, under tension so that when the magnetic force on the reed is removed by demagnetizing the element 24, the resiliency of the reed moves it upward and breaks its contact with the contact 24. This breaks the electrical connection of the conductive strips 22 and 28, thereby removing the short circuit from across the diode 32.

In this way, the reed 40 of the element 36 and the contact 24 form a reed switch which is in parallel with the diode 32 and serves to short the diode 32 when the element 36 is in its second position. Shorting the diode 32 in this manner provides effective deactivation of the tag 10 such that spurious signals are not reradiated by the tag 10 as a result of the deactivation. This reduces false alarms in the EAS system.

Figure 3A:
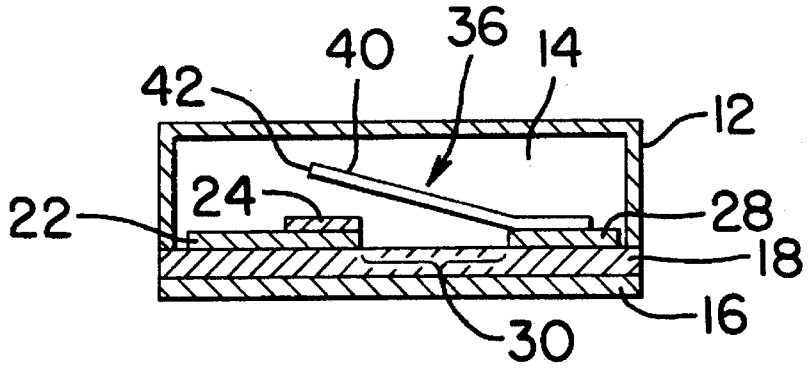
FIG. 3A–3B show cross section views of the EAS tag of FIG. 2 along a line 1—1 of FIG. 1.

The above operation of the tag 10 will now be described by referring to FIGS. 3A–3B. In FIG. 3A, the element 36 is shown in its first position wherein the reed 40 is suspended at a predetermined height above the contact 24. Typically, the end 42 of the reed 40 might be approximately 1–5 mils above the contact 24, although other suitable dimensions may be used. In this position, the diode 32 is not shorted. The tag 10 is thus activated and reradiates detectable signals in response to interrogating signals as above-described.

Figure 3B:
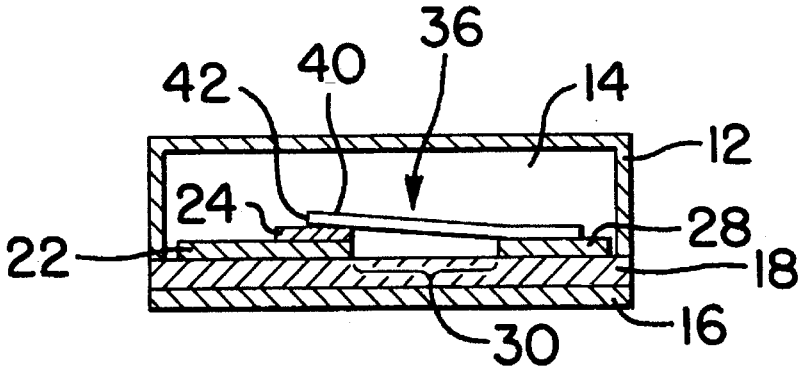
Figure 4:
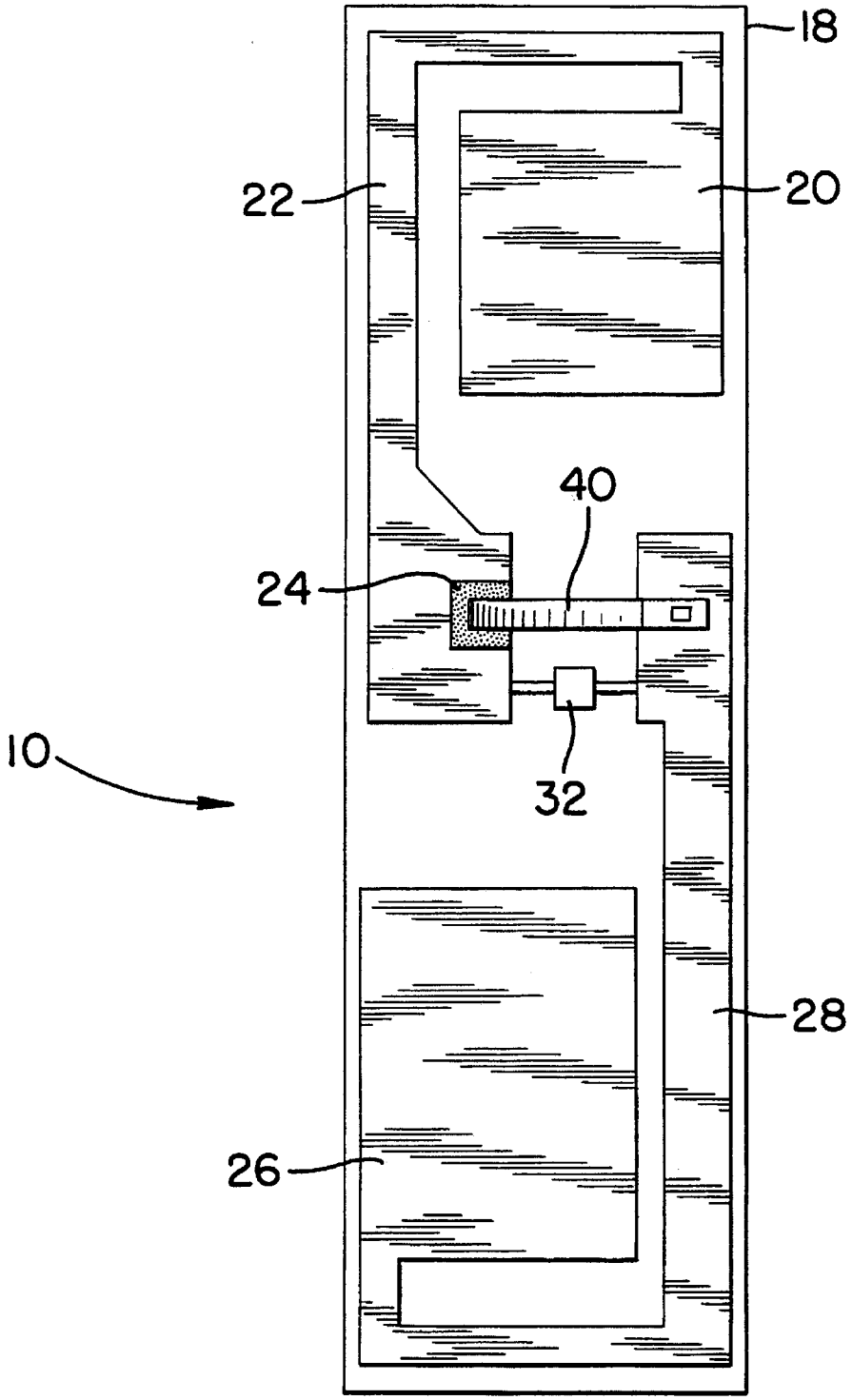
FIG. 4 illustrates a top view of the EAS tag of FIG. 2 with a top cover removed.

FIG. 3B shows the element 36 in its second position. In this position, the electrical connection between the end 42 of the reed 40 and the contact 24 shorts out the diode 32 and deactivates the tag 10.

As above-indicated, the element 36 is brought to its second position to deactivate the tag 10 by magnetizing the contact 24. Such deactivation and magnetizing can be realized using a conventional magnetic deactivator (not shown). Such a deactivator provides a magnetic field that typically extends 3.5 inches from the deactivator. To deactivate the tag 10, the tag 10 is placed within the magnetic field of the deactivator for a predetermined amount of time to magnetize the contact 24. Since the contact 24 is formed of a semi-hard material, it remains magnetized after the tag 10 is removed from the magnetic field. As a result, the reed 40 remains against the contact keeping the element 36 in its second position and the tag 10 deactivated.

In order to reactivate the tag 10, the contact 24 is demagnetized. This removes the magnetic force acting on the reed 40 allowing the resiliency of the reed to move the reed upwards and out of contact with the contact 24. This returns the element 36 to its first position, which reactivates the tag 10 since the diode 32 is no longer shorted out by the reed 40. Demagnetizing of the contact 24 can be realized by placing the tag 10 in an AC field for an appropriate period of time.

As can be appreciated, the tag 10 can be repeatedly deactivated and reactivated in its use in the EAS system 1. Moreover, deactivation and reactivation can be remotely carried out, thereby speeding up the deactivation and reactivation process.

In the discussion above of the tag 10 of FIG. 2, the element 36 of the tag was described as being formed from a soft magnetic material. However, the element 36 may also be fabricated from a semi-hard magnetic material, similar to the magnetic contact 24. In such case, the reed 40 of the element 36 is magnetized with a first polarity and is arranged to be against the contact 24 when the contact 24 is demagnetized. This corresponds to the second position of the element 36 in which the diode 32 is short circuited and the tag 10 deactivated.

By then magnetizing the contact 24 so that it is of an opposite magnetic polarity to that of the reed 40, the reed and contact repel each other and their contact is broken. The element 36 is thus brought to its first position in which the diode 32 is no longer short circuited, thereby reactivating the tag 10. If the contact 24 is then demagnetized, the reed 40 moves back in contact with the contact 24, due to the resiliency of the reed, returning the element 36 to its first position and deactivating the tag.

As above-noted, the contact 24 is fabricated from a semi-hard magnetic material. A typical semi-hard magnetic material might be Arnokrome having a composition of FeCoCr, although other materials may be used. The contact 24 may also be square shaped having approximate dimensions of 0.25 inch by 0.25 inch.

The soft magnetic material used for the element 36 may be a material such as Permalloy. Alternatively, a magnetostrictive alloy such as Metglas having an amorphous glass composition of $Fe_{44.45}$ $Mo_{7.35}$ $Ni_{44.45}$ $B_{3.74}$ may be used. The element 36 may be approximately 0.100 inches wide and 0.5 inches long, although other suitable sizes and shapes may be used. The diode 32 may be a standard PN junction type diode. Alternatively, a PIN junction type diode may be utilized in order to increase the sensitivity of the tag 10.

Figure 5:
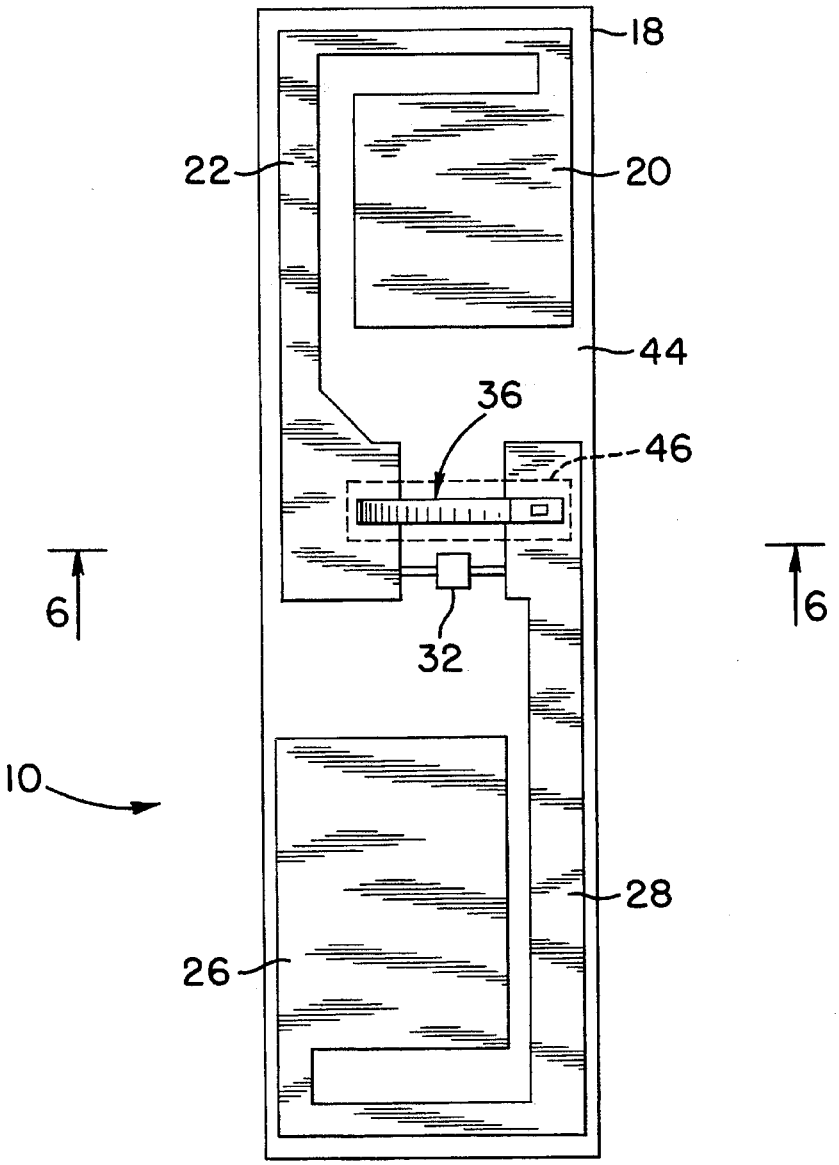
FIG. 5 shows a top view of an alternate embodiment of an EAS tag in accordance with the principles of the present invention having a magnetizable layer on a bottom surface.

FIG. 5, shows a modified embodiment of the tag 10 of FIG. 2. In this embodiment, the magnetic contact 24 has been replaced by a semi-hard magnetizing layer 46. The layer 46 is formed on a bottom surface 48 of the substrate 18 and extends underneath the length of the magnetic element 36 and portions of the first and second strips 22, 28, as shown by the dashed lines. This can be seen more clearly in the cross section of FIG. 6.

Figure 6:
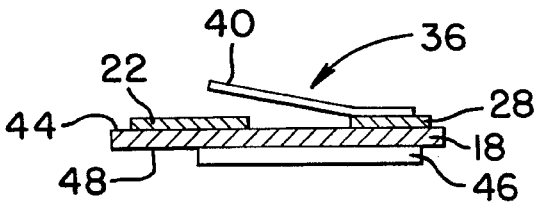
FIG. 6 is a cross sectional view of the EAS tag of FIG. 5 along the line 2—2 of FIG. 5.

In the tag 10 of FIGS. 5 and 6, when the magnetizing layer 46 is sufficiently magnetized, the resultant magnetic force acts on the entire length of reed 40 to pull it down and hold it directly against the first strip 22. This places the element 36 in its second position where it shorts the diode and deactivates the tag 10. By demagnetizing the layer 46, the reed 40 is released, braking the contact between the reed and the strip 22. This brings the element 36 to its first position where it no longer shorts the diode 32, thereby reactivating the tag 10.

Figure 7:
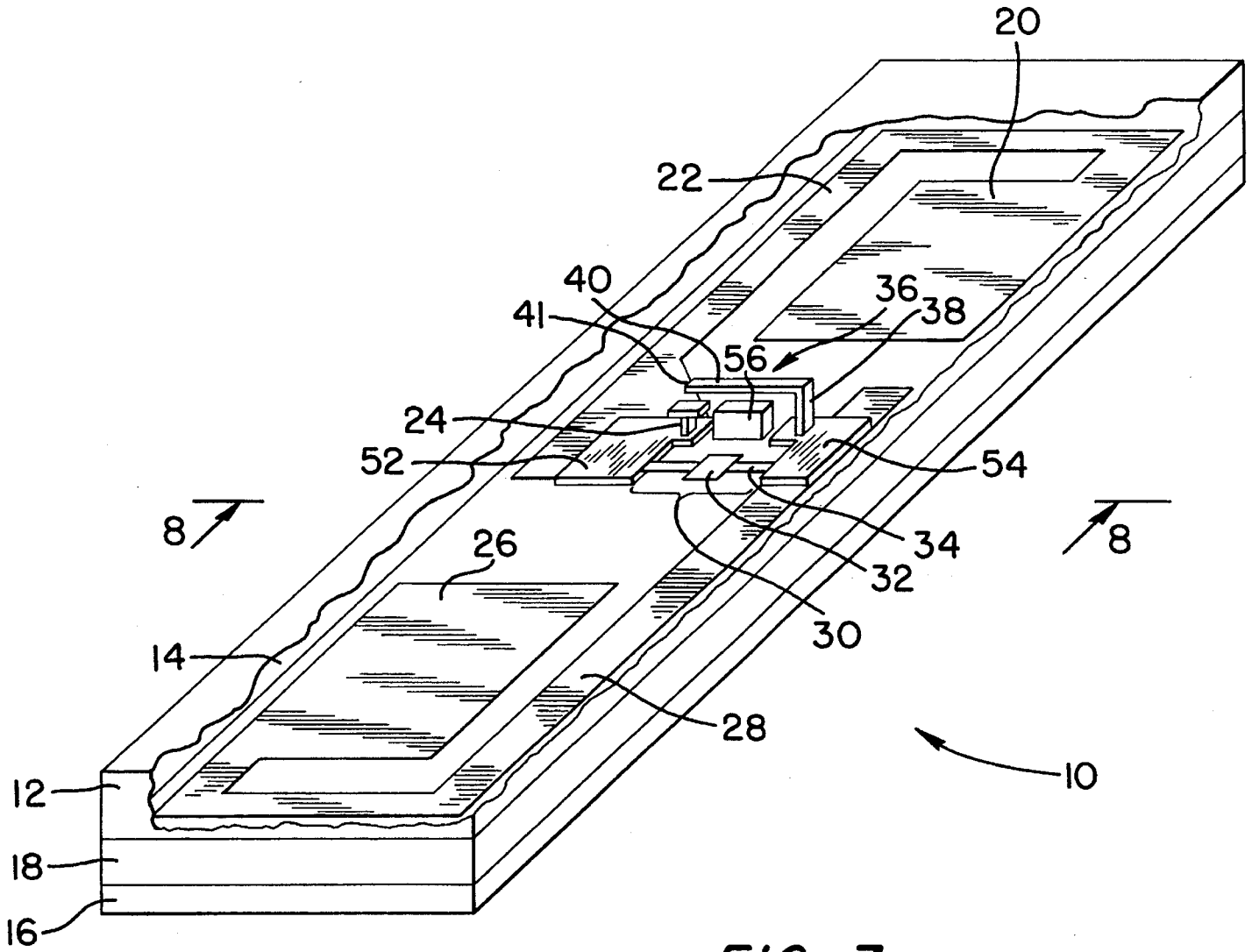
FIG. 7 is a partial cutaway view of a further embodiment of an EAS tag in accordance with the principles of the present invention.

FIG. 7 illustrates a further modified embodiment of the tag 10. In this embodiment, a first terminal 52 is electrically connected to the first strip 22 and a second terminal 54 is electrically connected to the second strip 28. The leads 34 of the diode 32 are electrically connected between the first and second terminals 52 and 54.

The substrate 18 includes a holding means in the form of an adhesive element 56 which is affixed between the first and second terminals 52 and 54. In this case, the soft magnetic element 36 with its base 38 and reed 40 form a cantilevered member such that the reed 40 is cantilevered over the adhesive element 56. The semi-hard magnetic contact 24, moreover, is raised so that it is adjacent the end 41 of reed 40.

Figure 8A:
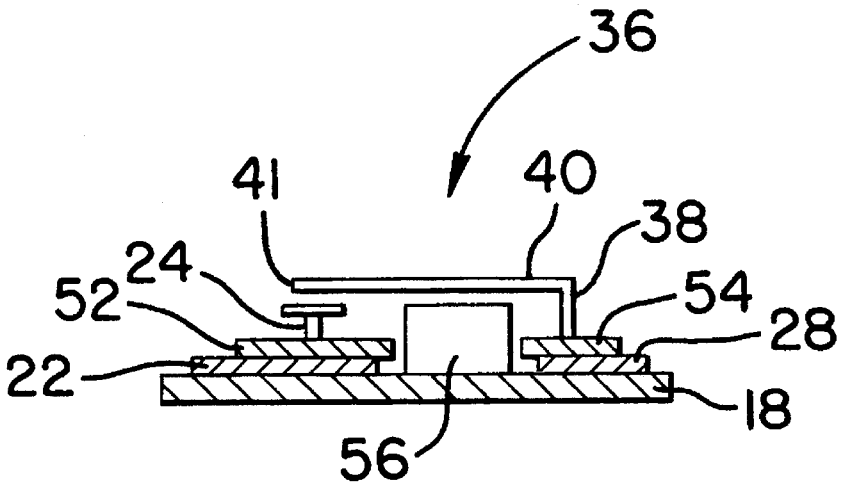
FIGS. 8A–8B show cross sectional views of the EAS tag of FIG. 7 taken along the line 3—3 of FIG. 7.
Figure 8B:
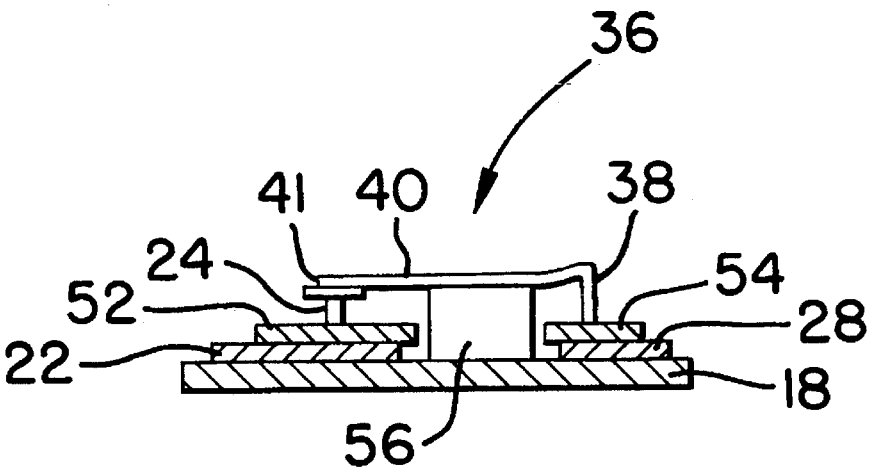

When the contact 24 is demagnetized, the contact and reed remain out of contact, as seen in FIG. 8A. This is the first position of the element 36 in which the diode 32 is not shorted and the tag 10 is activated. When the contact 24 is magnetized the reed 40 is brought in contact with the contact 24. This shorts the diode 32 and deactivates tag 10. However, the reed 40 also becomes adhered to the adhesive element 56. As a result, when the contact 24 is demagnetized, the reed stays fixed to element 56 and in contact with contact 24. The tag 10 thus remains deactivated and can no longer be reactivated by demagnetizing contact 24. The result is that the tag 10 becomes permanently deactivated.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What we claim is:

1. A deactivatable EAS tag comprising:

a circuit responsive to an interrogating signal applied to said EAS tag for causing the generation of a detectable signal, said circuit including: a substrate; first and second conductive elements situated on said substrate and having first and second portions, respectively defining a gap therebetween, and a non-linear element connected across said gap and having first and second terminals connected to said first and second portions, respectively, of said first and second conductive elements;

a first magnetic element having a first end connected to said first portion of said first conductive element and a second end situated adjacent to said second portion of said second conductive element; and a second magnetic element affixed to said second portion of said second conductive element so as to selectively magnetically influence said second end of said first magnetic element, said second magnetic element when in a first magnetic state causing said second end of said first magnetic element to be out of electrical contact with said second portion of said second conductive element and when in a second magnetic state causing said second end of said first magnetic element to be in electrical contact with said second portion of said second conductive element.

2. A deactivatable EAS tag in accordance with claim 1 wherein:

said first magnetic element comprises a magnetically soft magnetic material; and said second magnetic element comprises a magnetically semi-hard magnetic material.

3. A deactivatable EAS tag in accordance with claim 2 wherein:

said first magnetic state of said second magnetic element is a demagnetized state; and said second magnetic state of said second magnetic element is a magnetized state.

4. A deactivatable EAS tag in accordance with claim 3 wherein:

said first magnetic element has a fixed base at said first end of said first magnetic element which is thereby in electrical contact with said first portion of said first conductive element and with said first terminal of said nonlinear element and a flexible reed extending from said fixed base and terminating in said second end of said first magnetic element which is spaced from and thereby out of electrical contact with said second portion of said second conductive element and said second terminal of said non-linear element in the demagnetized state of said second magnetic element;

said second magnetic element is adjacent to said second terminal of said non-linear element and underlies said second end of said first magnetic element; and said second magnetic element when in said magnetized state causing said reed to bend and bring said second end of said first magnetic element in electrical contact with said second portion of said second conductive element and thereby with said second terminal of said non-linear element to short said non-linear element.

5. A deactivatable EAS tag in accordance with claim 4 further comprising:

means for holding said second end of said first magnetic element in contact with said second portion of said second conductive element when said second end of said first magnetic element is brought into electrical contact with said second portion of said second conductive member.

6. A deactivatable EAS tag in accordance with claim 5 wherein:

said holding means comprises an adhesive member which is arranged to come in contact with said first magnetic element when said second end of said first magnetic element is brought into contact with said second portion of said second conductive member.

7. A deactivatable EAS tag in accordance with claim 4 wherein:

said second magnetic element when changed from said magnetized to said demagnetized state permits said first magnetic element to return to a position in which said reed of said first magnetic element causes said second end of said first magnetic element to be spaced from and out of electrical contact with said second portion of said second conductive member and thereby said second terminal of said non-linear element so that said first magnetic element does not electrically short said non-linear element.

8. A deactivatable EAS tag in accordance with claim 7 wherein:

said non-linear element is a diode.

9. A deactivatable EAS tag in accordance with claim 8 in which:

said circuit is arranged to be responsive to one of a group comprises of a microwave interrogating signal and a RF interrogating signal.

10. A deactivatable EAS tag in accordance with claim 7 wherein:

said second magnetic element extends in one of the following way: only adjacent said first terminal of said non-linear element; and from adjacent said first to adjacent said second terminal of said non-linear element.

11. A deactivatable EAS tag in accordance with claim 1 wherein:

said first magnetic element comprises a semi-hard magnetic material magnetized with a first polarity; and said second magnetic element comprises a semi-hard magnetic material.

12. A deactivatable EAS tag in accordance with claim 11 wherein:

said first magnetic state of said second magnetic element is a magnetized state of a second polarity; and said second magnetic state of said second magnetic element is a demagnetized state.

13. A deactivatable EAS tag in accordance with claim 12 wherein:

said first magnetic element has a fixed base at said first end of said first magnetic element which is thereby in electrical contact with said first portion of said first conductive element and with said first terminal of said non-linear element and a flexible reed extending from said fixed base and terminating in said second end of said first magnetic element which is in electrical contact with said second portion of said second conductive element and said second terminal of said non-linear element in the demagnetized state of said second magnetic element;

said second magnetic element is adjacent to said second terminal of said non-linear element and underlies said second end of said first magnetic element; and said second magnetic element when in said magnetized state causing said reed of said first magnetic element to bend and bring said second end of said first magnetic element out of electrical contact with said second portion of said second conductive element and said second terminal of said non-linear element so as not to short said non-linear element.

14. A deactivatable EAS tag in accordance with claim 13 wherein:

said second magnetic element when changed from said magnetized to demagnetized state permits said first magnetic element to return to a position in which said reed of said first magnetic element causes said second end of said first magnetic element to be brought back into electrical contact with said second portion of said second conductive element and thereby said second terminal of said non-linear element so that said first magnetic element electrically shorts said non-linear element.

15. A deactivatable EAS tag in accordance with claim 14 wherein:

said non-linear element is a diode.

16. A deactivatable EAS tag in accordance with claim 13 wherein:

said circuit is arranged to be responsive to one of a group comprised of a microwave interrogating signal and a RF interrogating signal.

17. A deactivatable EAS tag in accordance with claim 16 wherein:

said second magnetic element extends in one of the following ways only adjacent to said first terminal of said non-linear element; and from adjacent to said first to adjacent to said second terminal of said non-linear element.

18. A deactivatable EAS tag in accordance with claim 14 further comprising:

means for holding said second end of said first magnetic element in contact with said second portion of said second conductive element when said second end of said first magnetic element is brought back into electrical contact with said second portion of said second conductive member.

19. A deactivatable EAS tag in accordance with claim 18 wherein:

said holding means comprises an adhesive member which is arranged to come in contact with said first magnetic element when said second end of said first magnetic element is brought back into electrical contact with said second portion of said second conductive member.

20. A deactivatable EAS tag in accordance with claim 1 further comprising:

means for holding said second end of said first magnetic element in contact with said second portion of said second conductive element when said second end of said first magnetic element is brought into electrical contact with said second portion of said second conductive element.

21. A deactivatable EAS tag in accordance with claim 20 wherein:

said holding means comprises an adhesive member which is arranged to come in contact with said first magnetic element when said second end of said first magnetic element is brought in contact with said second portion of said second conductive element.

22. An EAS system comprising:

means for transmitting an interrogating signal into an interrogation zone;

a deactivatable EAS tag comprising: a circuit responsive to an interrogating signal applied to said EAS tag for causing the generation of a detectable signal, said circuit including: a substrate; first and second conductive elements situated on said substrate and having first and second portions, respectively defining a gap therebetween, and a non-linear element connected across said gap and having first and second terminals connected to said first and second portions, respectively, of said first and second conductive elements;

a first magnetic element having a first end connected to said first portion of said first conductive element and a second end situated adjacent to said second portion of said second conductive element; and a second magnetic element affixed to said second portion of said second conductive element so as to selectively magnetically influence said second end of said first magnetic element, said second magnetic element when in a first magnetic state causing said second end of said first magnetic element to be out of electrical contact with said second portion of said second conductive element and when in a second magnetic state causing said second end of said first magnetic element to be in electrical contact with said second portion of said second conductive element;

and means for receiving said detectable signal caused to be generated by said tag.

23. An EAS system in accordance with claim 22 wherein:

said first magnetic element comprises a magnetically soft magnetic material;

said second magnetic element comprises a magnetically semi-hard magnetic material;

said first magnetic state of said second magnetic element is a demagnetized state; and said second magnetic state of said second magnetic element is a magnetized state.

24. An EAS system in accordance with claim 23 wherein:

said first magnetic element has a fixed base at said first end of said first magnetic element which is thereby in electrical contact with said first portion of said first conductive element and with said first terminal of said non-linear element and a flexible reed extending from said fixed base and terminating in said second end of said first magnetic element which is spaced from and thereby out of electrical contact with said second portion of said second conductive element and said second terminal of said non-linear element in the demagnetized state of said second magnetic;

said second magnetic element is adjacent to said second terminal of said non-linear element and underlies said second end of said first magnetic element; and said second magnetic element when in said magnetized state causing said reed to bend and bring said second end of said first magnetic element in electrical contact with said second portion of said second conductive element and thereby with said second terminal of said non-linear element to short said non-linear element.

25. An EAS system in accordance with claim 22 wherein:

said first magnetic element comprises a magnetically semi-hard magnetic material magnetized with a first polarity; and said second magnetic element comprises a magnetically semi-hard magnetic material;

said first magnetic state of said second magnetic element is a magnetized state of a second polarity; and said second magnetic state of said second magnetic element is a demagnetized state.

26. An EAS system in accordance with claim 25 wherein:

said first magnetic element has a fixed base at said first end of said first magnetic element which is thereby in electrical contact with said first portion of said first conductive element and with said first terminal of said non-linear element and a flexible reed extending from said fixed base and terminating in said second end of said first magnetic element which is in electrical contact with said second portion of said second conductive element and said second terminal of said non-linear element in the demagnetized state of said second magnetic element;

said second magnetic element is adjacent to said second terminal of said non-linear element and underlies said second end of said first magnetic element; and said second magnetic element when in said magnetized state causing said reed of said first magnetic element to bend and bring said second end of said first magnetic element out of electrical contact with said second portion of said second conductive element and said second terminal of said non-linear element so as not to short said non-linear element.

27. An EAS system in accordance with claim 22 further comprising:

means for holding said second end of said first magnetic element in contact with said second portion of said second conductive element when said second end of said first magnetic element is brought into electrical contact with said second portion of said second conductive element.

28. An EAS system in accordance with claim 27 wherein:

said holding means comprises an adhesive member which is arranged to come in contact with said first magnetic element when said second end of said first magnetic element is brought in contact with said second portion of said second conductive element.

* * * * *

UNITED STATES PATENT AND TRADEMARK OFFICE

CERTIFICATE OF CORRECTION

PATENT NO. : 5,608,379

DATED : March 4, 1997

INVENTOR(S) : Narlow et al.

It is certified that error appears in the above-indentified patent and that said Letters Patent is hereby corrected as shown below:

Col. 1, line 29, delete "Silkaria" and insert -- Siikarla --.

Col. 7, line 48, delete "comprises" and insert -- comprised of --.

Col. 7, line 53, delete "way:" and insert -- ways: --.

Col. 8, line 48, delete "ways" and insert -- ways: --.

Signed and Sealed this

Eighteenth Day of August, 1998

Bruce Lehman

*Attest:*

BRUCE LEHMAN

*Attesting Officer*

*Commissioner of Patents and Trademarks*